United States Patent [19]

Follstaedt et al.

[11] Patent Number: 5,063,988

[45] Date of Patent: Nov. 12, 1991

[54] METHOD AND APPARATUS FOR STRIP CASTING

[75] Inventors: Donald W. Follstaedt, Middletown, Ohio; John C. Powell, Pittsburgh, Pa.; Richard C. Sussman, West Chester; Robert S. Williams, Fairfield, both of Ohio

[73] Assignee: Armco Inc., Middletown, Ohio

[21] Appl. No.: 543,613

[22] Filed: Jun. 22, 1990

[51] Int. Cl.[5] ..... B22D 11/06

[52] U.S. Cl. ..... 164/463; 164/423

[58] Field of Search ..... 164/463, 423, 429, 479

[56] References Cited

U.S. PATENT DOCUMENTS

| | | | |
|---|---|---|---|
| 4,142,571 | 3/1979 | Narasimhan | 164/88 |
| 4,221,257 | 9/1980 | Narasimhan | 164/87 |
| 4,399,860 | 8/1983 | Johns | 164/423 |
| 4,475,583 | 10/1984 | Ames | 164/423 |
| 4,479,528 | 10/1984 | Maringer | 164/423 |
| 4,484,614 | 11/1984 | Maringer | 164/463 |
| 4,485,839 | 12/1984 | Ward | 164/463 |
| 4,617,981 | 10/1986 | Maringer | 164/453 |
| 4,768,458 | 9/1988 | Arakawa | 164/463 |
| 4,771,820 | 9/1988 | Williams | 164/463 |

*Primary Examiner*—Kuang Y. Lin

*Attorney, Agent, or Firm*—Larry A. Fillnow; Robert J. Bunyard; Robert H. Johnson

[57] ABSTRACT

Casting nozzles will provide improved flow conditions with the parameters controlled according to the present invention. The gap relationships between the nozzle slot and exit orifice must be controlled in combination with converging exit passageway to provide a smooth flow without shearing and turbulence in the stream. The nozzle lips are also rounded to improve flow and increase refractory life of the lips of the nozzle. The tundish walls are tapered to provide improve flow for supplying the melt to the nozzle. The nozzle is located about 45° below top dead center for optimum conditions.

13 Claims, 2 Drawing Sheets

METHOD AND APPARATUS FOR STRIP CASTING

The Government of the United States of America has rights in this invention pursuant to Contract No. DE-FC07-881D12712 awarded by the U.S. Department of Energy.

FIELD OF THE INVENTION

The present invention is directed to the field of continuous strand casting using a nozzle positioned before the top dead center of a rotating single roll or belt. More particularly, the present invention relates to a method and apparatus for continuous casting thin crystalline or amorphous strip. Molten material is supplied under a static pressure onto a rotating cooled substrate using flow rates determined by the desired strip thickness, substrate speed, substrate surface, bath material and other conditions.

BACKGROUND OF THE INVENTION

Casting thin crystalline strip or amorphous strip requires a critical control of the flow of the melt through the casting nozzle to produce the desired quality and thickness of cast strip. The various angles and openings used in nozzle design have an important influence on the flow of molten material onto a rotating substrate.

Casting amorphous strip continuously onto a rotating substrate has many of the general nozzle parameters defined in U.S. Pat. Nos. 4,142,571 and 4,221,257. These patents use a casting process which forces molten material onto the moving surface of chill body through a slotted nozzle at a position on the top of the chill body. Amorphous production also requires extremely rapid quench rates to produce the desired isotropic structures.

Metallic strip has been continuously cast using casting systems such as disclosed in U.S. Pat. Nos. 4,475,583; 4,479,528; 4,484,614 and 4,749,024 which are incorporated herein by reference. These casting systems are characterized by locating the nozzles back from top dead center or top of the rotating substrate and using various nozzle relationships which improve the uniform flow of molten metal onto the rotating substrate. The walls of the vessel supplying the molten metal are generally configured to converge into a uniform narrow slot positioned close to the substrate. The nozzle lips have critical gaps, dimensions and shape which are attempts to improve the uniformity of the cast product.

The prior nozzle designs for casting have not provided a uniform flow of molten metal onto the rotating substrate. The critical nozzle parameters have not been found which control stream spreading upon exiting of the nozzle, rolling of the stream edges, wave formation and the formation of a raised stream center.

The present invention has greatly reduced these non-uniform stream conditions and provided a more consistent flow by a nozzle design which requires the critical control of several nozzle parameters.

SUMMARY OF THE INVENTION

The nozzle of the present invention has several design features which provide a uniform flow of molten metal and cast strip having reduced edge effects. The major nozzle features include the control of the tundish wall slope which supply the molten metal, the nozzle gap opening, the shape of the nozzle walls, the gaps between the nozzle and the rotating substrate and the general relationship between these variables.

The strip casting system of the present invention includes a tundish or reservoir to supply molten metal to a casting nozzle. The supply walls are configured to provide a smooth flow of molten material to the casting nozzle. In a preferred casting system, the supply walls are sloped at an angle of about 15° to about 90° to the perpendicular angle of the nozzle discharge of molten metal onto a cooled and rotating substrate. The nozzle is positioned at a location before top dead center and preferably at an angle of about 5° to 90° before top dead center or top of the rotating substrate. The nozzle has a slot opening of about 0.01 to about 0.30 inches which is related to the strip thickness. A converging nozzle exit angle C of about 1° to 15° is used with a nozzle exit gap which must be less than nozzle slot opening and greater than the thickness of the strip being cast. A preferred converging nozzle angle is from 3° to 10°. The approach angle E of the nozzle slot to the substrate is from about 45° to 120° and preferably from about 60° to 90°. The molten metal is cast onto a rotating substrate and solidified into strip.

The nozzle slot opening is further characterized by a relationship to the gap between the substrate and the exit of the nozzle. The nozzle slot is greater than the exit gap distance which reduces strip shearing. The converging angle of molten metal discharge from the nozzle produces a stream with uniform thickness.

A principle object of the present invention is to provide an improved casting nozzle for casting strip with improved quality and uniformity over a wide range of strip widths and thicknesses.

Another object of the present invention is to provide a strip casting nozzle which may be used in combination with a wide range of tundish and substrate systems to cast amorphous and crystalline strip or foil from a wide range of melt compositions.

Among the advantages of the present invention is the ability to cast strip or foil having improved surface and uniform thickness.

Another advantage of the present invention is the ability to increase the range of static head pressure in the melt reservoir which can be used. The more restricted flow conditions provided by the nozzle of the present invention allow the broader range of pressures from the melt supply which still produce uniform strip.

Other objects and advantages of the present invention will become apparent from the following detailed description of the preferred embodiments and related drawings.

DETAILED DESCRIPTION OF THE PREFERRED EMBODIMENTS

Figure 1:
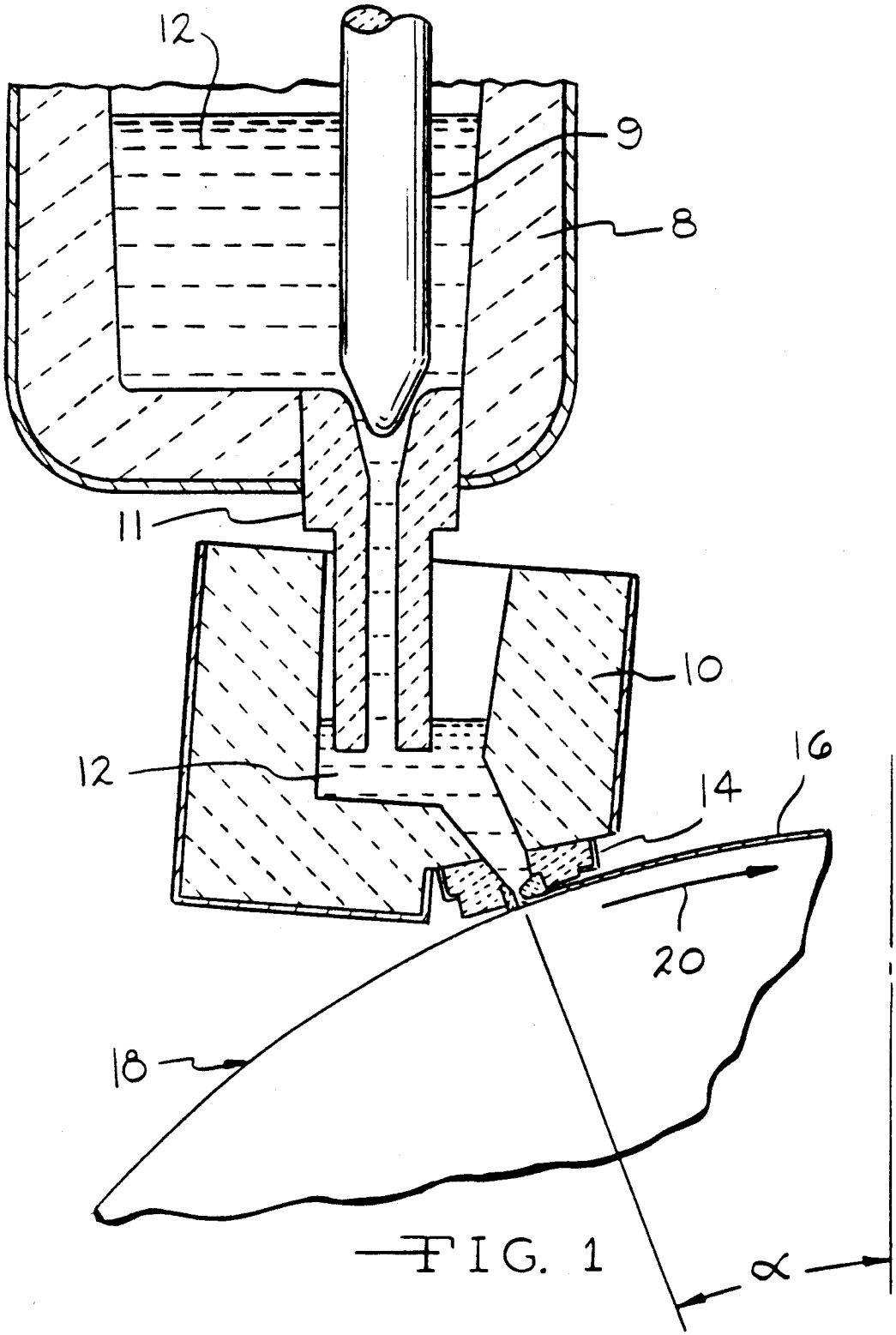
FIG. 1 is diagrammatic elevational view, partially in cross-section, illustrating a typical apparatus of the present invention used for continuously casting strip.

The present invention is generally illustrated in FIG. 1 wherein a casting system is shown as including a ladle 8 which includes a stopper rod 9 for controlling the flow of molten material 12 into a tundish or reservoir 10. Molten material 12 is supplied to a casting nozzle 14 for producing cast strip 16 on a rotating substrate 18 which is cooled and rotates in direction 20. The nozzle is generally located at an angle $\alpha$ before top dead center or the top of the rotating substrate 18 and typically about 5° to 90° before top dead center, and preferably about 15 ° to 60°.

Figure 2:
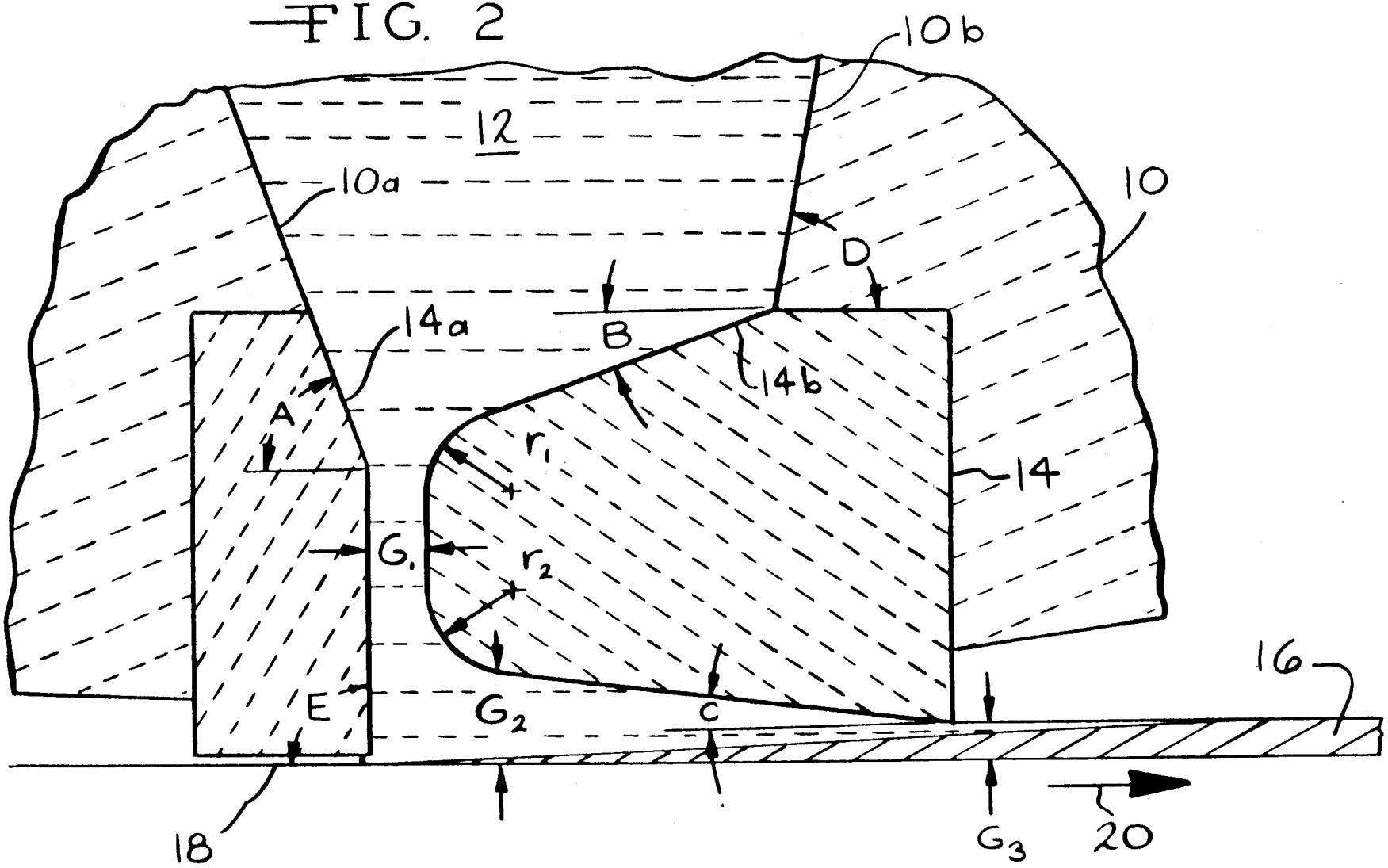
FIG. 2 is cross-sectional view of a nozzle of the present invention.

Referring to FIG. 2, molten material 12 is fed to nozzle 14 through tundish walls 10 made of a suitable high temperature refractory material which are configured to improve the flow by providing a sloped angle A of about 15° to 90° and preferably about 45° to 75° to the nozzle gap $G_1$ along rear tundish wall 10*a*. The front tundish wall 10*b* is generally configured at an angle of about 15° to 90° and preferably sloped from 60° to 90° and is represented by angle D in FIG. 2.

Nozzle 14, made from a refractory such as boron nitride, has a rear nozzle wall 14*a* which is normally an extension of rear tundish wall 10*a* with the same general slope. However, the flow of melt between the supply walls and the nozzle in the broadest terms of the invention requires that a smooth flow at the junction be provided and the slope of the supply walls and nozzle walls may be different. The front nozzle wall 14*b* is a more gradual slope with an angle of about 5° to 45° and preferably 10° to 45° and typically about 15° to 30°. This slope is identified as angle B in the drawing. The combination of slopes in these walls produces a smooth flow of molten metal into the nozzle 14. The upper shoulder of nozzle 14*b* has further been shown to improve molten flow when the nozzle is rounded as shown by $r_1$. The rounding of the shoulders in the nozzle design also reduces turbulence in the stream, reduces clogging in the slot, reduces breakage and wear of the nozzle and produces a more uniform cast strip. The slope of the nozzle walls also improves heat transfer from the melt to the nozzle area near the substrate since the thickness is reduced and this helps to reduce freezing.

The gap $G_1$ between nozzle walls 14*a* and 14*b* is about 0.01 to about 0.3 inches and typically about 0.05 to 0.10 inches for casting strip of about 0.03 to 0.05 inches. The length of the slot between the parallel faces of nozzle walls 14*a* and 14*b* may vary but successful casting trials have resulted with a length of about 0.25 to about 0.5 inches. The front nozzle wall 14*b* has a lower rounded portion identified by $r_2$ which improves the flow of the stream and strip uniformity. The rounding of the nozzle portions $r_1$ and $r_2$ will also reduce wear and breakage in these areas.

The distance between the lower portion of front wall 14*b* and substrate is determined based on the balance between the casting parameters and the desired strip thickness and identified as $G_2$ in the drawing. $G_2$ is determined by the relationship to the size of G3 and the converging angle C used.

The distance between the substrate and nozzle is tapered with the use of a converging nozzle until the partially solidified strip exits the nozzle. The converging nozzle is typically at an angle C of about 1° to 15° with respect to the substrate 18. The opening in the nozzle at the point of exit is identified as $G_3$ and is at least the height of the desired strip thickness. The opening of $G_3$ is less than $G_2$ since the nozzle converges and is also less than $G_1$. The relationship of these gap openings in combination with the converging nozzle, position on the wheel and melt delivery angle to the wheel will result in an improved casting system.

The present nozzle system provides a method and apparatus for controlling a molten stream being removed by a rotating substrate. The pulling action provided by the rotational speed of a substrate, such as a wheel, drum or belt, provides a flow pattern or spreading action which must be counteracted by a molten metal flow pattern through the casting nozzle. An increase in static head pressure would increase the flow rate but this approach tends to increase turbulence and cause flow patterns which have an adverse influence on surface quality. The flow of molten material through the nozzle has an important influence on the flow onto the substrate and this understanding has not been completely understood in the past. The present invention has found that restricting the flow through the nozzle tends to produce a flatter stream which is more uniform and beneficial to control of the cast strip.

The use of pressurized flow from the casting nozzle allows a greater flexibility to increase the angle before top dead center of the substrate. Moving further back from the top of the substrate produces a casting process with a longer contact time between the molten material and the substrate for a given rotational speed of the substrate. The longer contact with the substrate increases the overall ability to extract heat during solidification.

The approach angle A has been found to improve the smoothness of the flow exiting from the nozzle, particularly in comparison with nozzles having a perpendicular approach angle.

The relationship between the gaps $G_1$, $G_2$ and $G_3$ is very critical to the obtaining of improved flow and more uniform strip. When gap $G_1$ is greater than gap $G_3$, the tendency for molten metal back flow is far more controllable. The narrow stream produced at $G_3$ is more controlled and uniform. This gap relationship provides a full channel in the nozzle and constant melt contact with the nozzle roof. The melt contact with the roof at $G_3$ produces a more uniform flow and a more uniform cast product. If the roof contact by the molten metal is intermittent, it causes fluctuations in the stream and a nonuniform cast strip. Restrictive flow through the nozzle tends to reduce the tendency for stream thinning and high flow regions in the center of the strip being cast. Restrictive flow also tends to minimize stream edge effects.

The benefits of a converging nozzle are shown in TABLE 1. It was demonstrated that a converging nozzle produced a more uniform flow and forced the stream to remain flat and in contact with the rotating substrate. A diverging nozzle allowed the stream to roll up at the center or the edges. The control of gap $G_3$ is also very important to the uniformity of the stream in the casting operation but the converging nozzle improved the casting conditions even for large $G_3$ conditions. With $G_3$ less than $G_1$, the nozzles provided excellent flow characteristics. There was very little spreading of the stream and stable flat flow was produced with excellent edge control. Rounding of the nozzle corners, $r_1$ and $r_2$, was found to reduce the formation of eddy currents in the stream and provide a smoother and more uniform flow condition. Sharp corners on the inside surfaces and outer lips are subject to large pressure drops and strong recirculating patterns which create stress, clogging and possible refractory wear or breakage. The prior art has rounded corners in some designs, such as U.S. Pat. No. 4,479,528 but taught a diverging nozzle should be used to reduce turbulence and improve flow. The present invention has found a restrictive nozzle passageway increases uniformity in metal flow and the quality of the cast strip.

The gap dimension for $G_1$ is critically defined as greater than the opening $G_3$. Although the ranges for other nozzle designs may overlap some of the nozzle parameters of the present invention, the specific nozzle gaps and flow parameters have not been suggested which would produce the results of the present nozzle design.

TABLE 1

| Trial | Angle BTDC. | Approach Angle, E | Secondary Gap, $G_3$(in) | Exit Angle C+ = Diverg. |
|---|---|---|---|---|
| 1 | 15° | 90° | 0.05 | +5 |
| 2* | 15 | 90 | 0.05 | −5 |
| 3 | 15 | 60 | 0.15 | +5 |
| 4 | 15 | 60 | 0.05 | +5 |
| 5 | 15 | 60 | 0.15 | −5 |
| 6* | 15 | 60 | 0.05 | −5 |
| 7 | 15 | 90 | 0.15 | −5 |
| 8 | 15 | 90 | 0.15 | +5 |
| 9 | 45 | 60 | 0.05 | +5 |
| 10* | 45 | 60 | 0.05 | −5 |
| 11* | 45 | 90 | 0.05 | −5 |
| 12 | 45 | 60 | 0.15 | −5 |
| 13 | 45 | 90 | 0.15 | +5 |
| 14 | 45 | 60 | 0.15 | +5 |
| 15 | 45 | 90 | 0.05 | +5 |
| 16 | 45 | 90 | 0.15 | −5 |

*Nozzles of the invention

The results of the water model studies shown in Table 1 demonstrated the flow characteristics of the nozzles of the present invention. A simulated 7 foot diameter wheel with melt head pressures varied between 3 and 16 inches and substrate speeds from 2 to 20 feet per minute were evaluated for nozzle slots of 0.15, 0.10 and 0.05 inches ($G_1$). The simulated strip thickness was varied between 0.025 to 0.095 inches and was 3 inches wide. The observations of the flow conditions supported the benefits of the superior nozzle design of the present invention over a wide range of conditions. Trials 5,7,12 and 16 did not produce uniform flow conditions because the secondary gap $G_3$ was greater than the nozzle slot $G_1$. The use of a converging nozzle improved the flow compared to the diverging trials but needed to maintain the required gap relationships to obtain the full benefits of the present invention.

Molten low carbon steel with a ferrostatic head of 16 inches and a casting temperature of about 2880° F. was cast on a 7 foot diameter copper wheel. The nozzle slot $G_1$ was 0.10 inches. The substrate speed was varied between 2 to 20 feet per minute to evaluate the various nozzle parameters and their influence on flow rates and strip quality. Uniform cast strip of about 3 inches wide and about 0.035 to 0.04 inches thick was produced with the converging nozzles of the present invention with the approach angle of the delivery and casting position on the wheel according to the present invention. The nozzle designs having a gap $G_3$ greater than $G_1$ did not produce the desired flow conditions and strip quality due to the gap relationship of the present invention.

Whereas the preferred embodiments have been described above for the purpose of illustration, it will be apparent to those skilled in the art that numerous modifications may be made without departing from the invention.

We claim:

1. An apparatus for continuously casting metal strip comprising:

a) a tundish for receiving and holding molten metal having a rear tundish wall and a front tundish wall for supplying said molten metal;

b) a cooled rotating substrate which is at least as wide as said metal strip; and c) a nozzle connected to said tundish comprising a rear teeming nozzle wall being at an approach angle of 45° to 120° to said substrate and connected to said rear tundish wall, a front teeming nozzle wall connected to said front tundish wall, a nozzle slot gap between said rear and front teeming nozzle walls of about 0.01 to 0.3 inches and a converging opening at the point of exit with an exit nozzle gap less than said nozzle slot gap.

2. An apparatus as claimed in claim 1 wherein said converging orifice has an angle of 1° to 15° to said substrate.

3. An apparatus as claimed in claim 1 wherein said nozzle slot gap between said front teeming nozzle wall and said rear teeming nozzle wall is about 0.05 to 0.10 inches and is parallel.

4. An apparatus as claimed in claim 1 wherein said rear teeming nozzle wall is an extension of said rear tundish wall and said walls form an angle of about 15° to 90° to said nozzle slot.

5. An apparatus as claimed in claim 1 wherein said front tundish wall is sloped at an angle of about 15° to 90° to said nozzle.

6. An apparatus as claimed in claim 1 wherein said nozzle is positioned at a location of 5° to 90° before the top of the substrate.

7. An apparatus as claimed in claim 6 wherein said nozzle is positioned at a location of about 15° to 60° before the top of the substrate.

8. An apparatus as claimed in claim 1 wherein said front teeming nozzle wall is sloped at an angle of about 5° to 45° to said nozzle slot.

9. A strip casting apparatus comprising:

a) a tundish;

b) a casting nozzle having a nozzle slot opening; and c) a rotating substrate having a converging gap opening at the point of exit between said substrate and said nozzle which is less than said nozzle slot opening.

10. The casting apparatus claimed in claim 9 wherein said nozzle is positioned about 15° to 60° before the top of said substrate.

11. A method of continuously casting metallic strip including the steps of:

a) providing a source of molten metal;

b) supplying a casting nozzle with said molten metal wherein said casting nozzle has a nozzle slot opening of about 0.01 to 0.3 inches;

c) positioning a cooled rotating substrate at a distance at least the height of the desired strip thickness at the point of strip exit from said nozzle; and d) casting said metallic strip from said casting nozzle onto said rotating substrate through a converging opening at the point of exit between said casting nozzle and said substrate which is less than said nozzle slot opening whereby said casting method provides a smooth metal flow onto said substrate due to increased restriction between said casting nozzle and said rotating substrate.

12. A method of reducing ferrostatic head pressure requirements for a continuous strip casting nozzle having a nozzle slot opening wherein molten metal is supplied from a source of molten metal above said casting nozzle for casting onto a rotating substrate below said casting nozzle, said method comprising the steps of restricting the flow of molten metal through said casting nozzle using a converging nozzle opening at the point of exit between said casting nozzle and said substrate, adjusting said nozzle opening at said exit above said substrate to be less than the opening of said nozzle slot and adjusting the speed of said rotating substrate to provide a flow of molten metal which provides a full channel in said casting nozzle with constant contact between said molten metal and said nozzle roof.

13. The method of claim 12 wherein said source of molten metal is supplied to said nozzle between tundish refractory walls having a rear tundish wall with a slope of 15° to 90° to said nozzle slot and a front tundish wall having a slope of 15° to 90° to a front nozzle wall to provide a smooth flow of molten metal onto said substrate from said nozzle positioned about 5° to 90° before the top of said substrate.

* * * * *